US005214941A

United States Patent [19]

Essig

[11] Patent Number: 5,214,941

[45] Date of Patent: Jun. 1, 1993

[54] PROCESS FOR PRODUCING A FULLY FASHIONED FLAT FABRIC FOR A GARMENT EQUIPPED WITH SLEEVES

[75] Inventor: Horst Essig, Hülben, Fed. Rep. of Germany

[73] Assignee: H. Stoll GmbH & Co., Reutlingen, Fed. Rep. of Germany

[21] Appl. No.: 744,379

[22] Filed: Aug. 13, 1991

[30] Foreign Application Priority Data

Aug. 31, 1990 [DE] Fed. Rep. of Germany ..... 4027606

[51] Int. Cl.[5] ..... D04B 1/24

[52] U.S. Cl. ..... 66/175; 66/171

[58] Field of Search ..... 66/171, 175, 187, 189, 66/148

[56] References Cited

U.S. PATENT DOCUMENTS

| | | | |
|---|---|---|---|
| 2,319,771 | 5/1943 | Beers | 66/187 |
| 3,374,645 | 3/1968 | Cointe | 66/189 |
| 3,474,643 | 10/1969 | Robinson et al. | 66/189 |
| 3,796,068 | 3/1974 | Betts et al. | 66/189 X |
| 3,882,697 | 5/1975 | Betts et al. | 66/189 X |
| 3,956,908 | 5/1976 | Betts et al. | 66/175 |

FOREIGN PATENT DOCUMENTS

| | | | |
|---|---|---|---|
| 2502574 | 7/1975 | Fed. Rep. of Germany | 66/171 |
| 2362958 | 8/1976 | France | 66/175 |

*Primary Examiner*—Clifford D. Crowder
*Assistant Examiner*—John J. Calvert
*Attorney, Agent, or Firm*—Larson and Taylor

[57] ABSTRACT

In the process for producing a fully fashioned flat fabric for a garment equipped with sleeves, first one of two body part, for example front parts (10), and additionally the two sleeves (11, 12) are knitted with separate yarn guides (A, B, C) to the completion of the sleeves. Subsequently, further knitting is carried out only with the yarn guide (A) for the front part (10), the end edges (11*a*, 12*a*) of the sleeves (11, 12) being tied stitch by stitch, by transfer, to the further formed body parts of the fabric. Thus the two sleeves (11, 12) are brought out of their original position parallel to the front part (10) into a desired transverse position in the finished flat fabric.

8 Claims, 3 Drawing Sheets

PROCESS FOR PRODUCING A FULLY FASHIONED FLAT FABRIC FOR A GARMENT EQUIPPED WITH SLEEVES

FIELD OF THE INVENTION

The invention relates to a process for producing a fully fashioned flat fabric for a garment equipped with sleeves on a two-bed flat knitting machine with a needle-bed racking device, stitch-transfer device and pattern device.

BACKGROUND OF THE INVENTION

Various processes for producing a one-piece garment blank on a flat knitting machine have already become known or been proposed. Thus, for example, German Offenlegungsschrift 1,811,029 makes known a process in which the knitting of the flat-knitted one-piece garment blank begins at that end which is to limit the neck opening in the finished garment. Then, by the use of the so-called gusseting technique, the number of wales is increased during the knitting of the shoulder region of the garment, in order to bring the sleeve portions into a desired angular position relative to the body parts of the blank. German Offenlegungsschrift 2,614,283 has proposed a process in which the one-piece garment blank is started at the ends of the sleeve portions and at the end of a front part or back part remote from the neck and is subsequently knitted in the shoulder region with continuous courses by means of a progressive intershaping of the outer regions of the portions in accordance with a desired run of the transitions between the sleeves and the shoulder region. German Patent Specification 2,803,338 makes known a process in which the sleeve portions of a garment blank produced in one piece are brought into a desired final position relative to the body parts of the garment blank by the formation of bulges in the shoulder region, obtained by an increase in the number of stitches of the generally continuous wales.

Various disadvantages have to be allowed for in all the processes known previously. Either flat knitting machines with a long needle-bed length are needed to produce the garment blank, or the sleeves have not only to be closed, but be also at least partially connected to the body parts of the fabric blank by seams. There are therefore severe restrictions on the shaping of the finished garment and strict limitations to the possibility of patterning of the regions of the garment.

SUMMARY OF THE INVENTION

The object on which the invention is based is to design a process of the type mentioned in the introduction in such a way that in the flat fabric there is complete freedom in the patterning of the sleeves and of the body parts of the garment in accordance with the possibilities of a particular pattern device used and the connection of the sleeve parts to the body parts is obtained whilst avoiding a time-consuming gusseting technique and without seams in the shoulder region.

The object is achieved, according to the invention, by means of a process in which one or two body parts, for example front parts, and the two sleeves from their ends are first knitted separately and simultaneously according to a pattern as far as the sleeve ends with yarns supplied by separate yarn guides. From then on the front part and a shoulder region are knitted by the use of the yarn guide employed hitherto for the adjacent body part, for example front part. At the same time the end course of the sleeves is transferred inwards stitch by stitch in the direction of the shoulder region, until at the start of, for example, the back part, the sleeve end edges are pivoted inwards completely against the body parts. Thus the last body part, for example the back part, is subsequently knitted with a firm end edge by the use of the same yarn guide, and a neck opening formed in the shoulder region is equipped with a run-proof edge formed in the knitting run.

In the process according to the invention, in contrast to the processes known or proposed hitherto, the sleeves are first virtually finish-knitted together with a body part adjacent to them with separate yarn guides, starting respectively with the front end of the sleeves.

For this, the active length of the needle bed need have only a number of needles which corresponds to the sum of the wales of the front part and of the circumference of the two sleeves. When the sleeves have reached their full length, further work for forming the remaining flat fabric, that is to say its shoulder region and its back part, is carried out only with that yarn guide with which the front part or front parts located between the two sleeves have been formed. At the same time the sleeve end edges are transferred stitch by stitch in the direction of the shoulder region. This ensures that, in the flat fabric released from the knitting zone, the sleeves first knitted parallel to the front part are pivoted into a transverse position relative to the longitudinal direction of the front part. After the front part and the back part of the flat fabric have been laid one onto the other, the garment can be completed by the formation of two side seams. These side seams connect the side edges of the front part and back part to one another, close the sleeves, and run through the armpit.

For pivoting the finish-knitted sleeve regions inwards, as mentioned, continuous relieving courses can advantageously be knitted at regular intervals over the shoulder region and an entire sleeve end edge. This relieves the transferred stitches, before a new transfer of stitches takes place for the purpose of continuing the attachment of the sleeves to the shoulder region.

In the process according to the invention, no gusseting in the flat fabric is necessary. Since the sleeves are knitted by the use of separate yarn guides, they can have over their entire length any desired patterning, even differing from the patterning of the body parts of the fabric. Since the yarn guide used for the body part located between the sleeves is employed during the pivoting of the finish-knitted sleeve regions into the shoulder region, a clean stitch transition is obtained without the formation of holes at the starting points of the sleeves. A further essential advantage of the process according to the invention is that the body part knitted last, for example the back part, is knitted with a firm end edge. For this, for example, a rib border can be knitted at the end of the back part. According to the invention first all the stitches are transferred onto one of the two needle beds, and subsequently a net course and a single-bed course in each needle bed are knitted, before the rib border is knitted to the desired length on both needle beds. According to the invention, to form the firm fabric end edge, first all the stitches can be transferred onto one of the two needle beds, and subsequently a run-proof binding-off of the fabric can be carried out by successive transfer of the individual stitches from one fabric edge into the free needle bed. After the racking of the free needle bed, an individual retransfer of the stitches can take place. For this, and also for forming a run-proof edge at the neck opening of the flat fabric, a process which is the subject of the applicant's German Patent Application P 39 39 584.7 of 30.11.1989 can appropriately be employed.

The process according to the invention is explained in more detail below by means of the accompanying drawings.

DETAILED DESCRIPTION OF THE PREFERRED EMBODIMENTS

Figure 1:
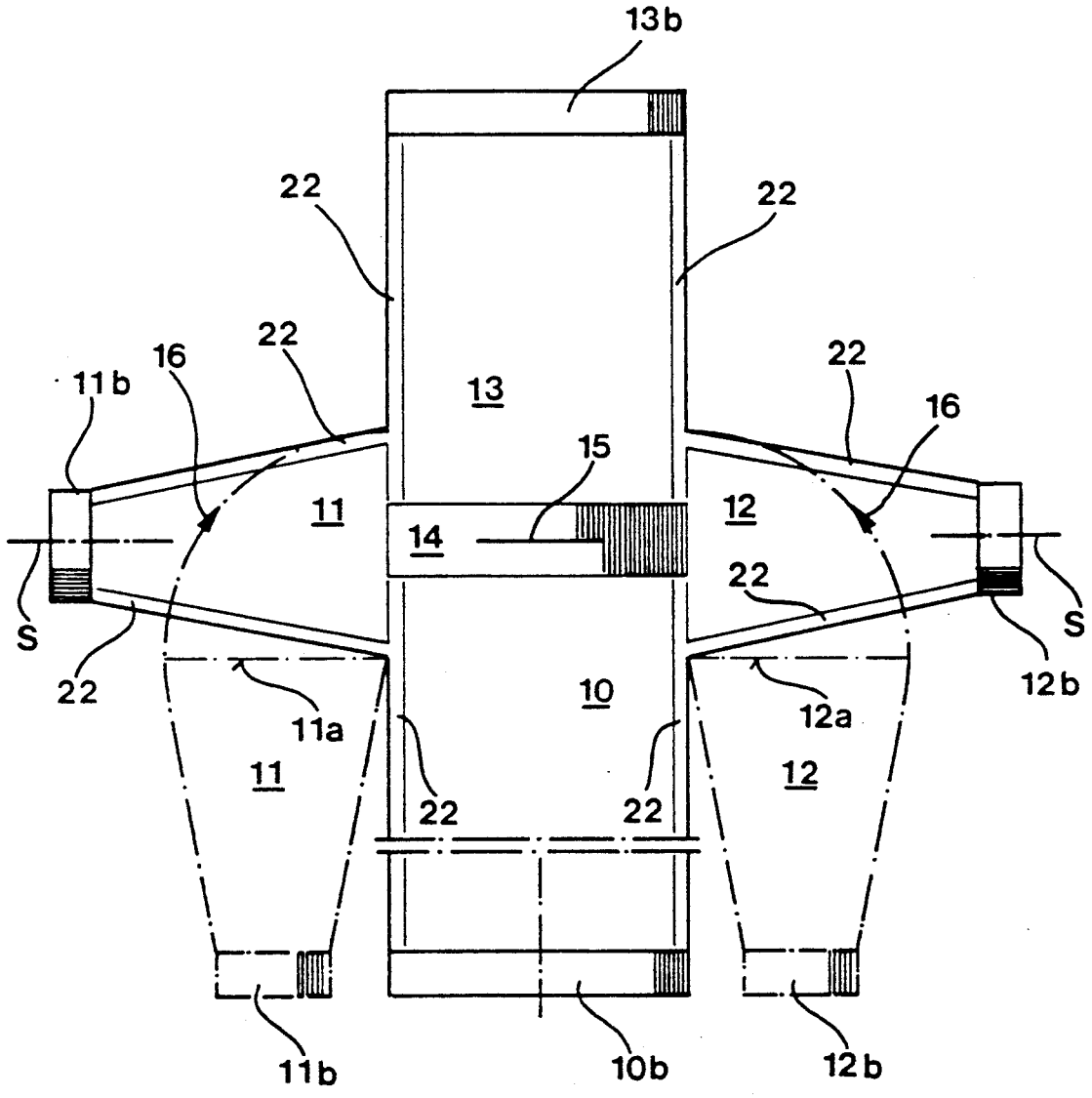
FIG. 1 shows a diagrammatic top view of a flat fabric produced fully fashioned according to the process.

FIG. 1 shows a flat fabric produced in one piece for a long-sleeved pullover, as obtained after release from the flat knitting machine. The one-piece flat fabric produced on a two-bed flat knitting machine with a needle-bed racking device, stitch-transfer device and pattern device is divided into a front (body) part 10, two sleeve parts 11, 12, a back (body) part 13 and, between the front part 10 and back part 13, a shoulder region 14 with a slit-like neck opening 15. Each part of the flat fabric can have any desired patterning. Dot-and-dashed lines represent the two sleeve parts 11 and 12 as first knitted together with the front part 10 on the flat knitting machine. Then, during the finish-knitting of the front part 10, of the shoulder region 14 and of the start of the back part 13, these two sleeve parts 11 and 12 are coupled to the above-mentioned body parts by means of their end course 11*a*, 12*a*, as indicated by arrows 16.

The front part 10, back part 13 and the two sleeve parts 11, 12 each have a rib edge 10*b*, 11*b*, 12*b*, 13*b* at their free ends. Lines 22 indicate the seam lines along which the one-piece flat fabric is subsequently sewn together to form a pullover, after the flat fabric has been folded along the bisecting line S. This gives rise to two side seams which extend from the body part via the armpits into the sleeves.

Figure 2:
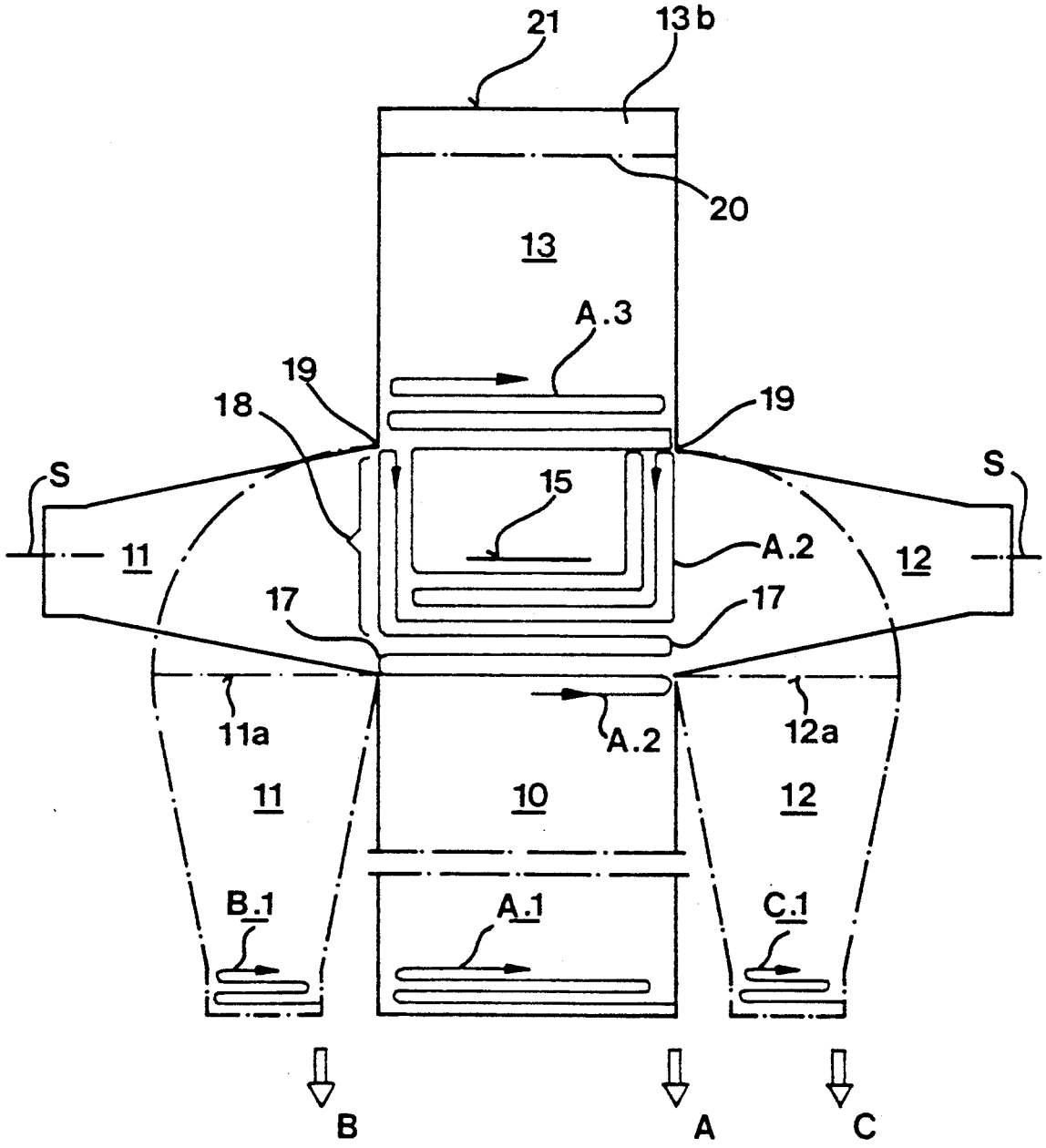
FIG. 2 shows a representation, corresponding to that of FIG. 1, of a flat fabric illustrating the guide paths of the individual yarn guides used.

The representation of the flat fabric in FIG. 2 indicates three yarn guides A, B and C at the lower margin, and arrowed lines indicating the path of the yarn guides illustrate the fabric formation in the individual regions of the fabric. Initially, the knitting of the rib edges 10*b*–12*b* of the front part 10 and of the two sleeves 11 and 12 is started. Thus, the yarn guide A is used for knitting the front part 10, the yarn guide B for knitting the sleeve part 11 and the yarn guide C for knitting the second sleeve part 12. The arrowed lines A.1, B.1 and C.1 show the movement of the yarn guides during the formation of the individual courses. When the two sleeve parts 11 and 12 are finish-knitted with the end courses 11*a* and 12*a*, further work is carried out with only the yarn guide A. The arrowed line A.2 indicates the fabric run in the transitional region between the front part 10 and the back part 13 of the flat fabric, in which the transverse pivoting of the sleeve parts 11 and 12 and their coupling to the body parts of the flat fabric takes place. At the machine-carriage reversal points corresponding to the yarn-guide reversal points 17, the end courses 11*a*, 12*a* of the sleeve parts 11, 12 are transferred inwards stitch by stitch. The connection, indicated by a bracket 18, thereby obtained between the sleeve parts 11, 12 and the adjacent body parts of the flat fabric is, of course, stretched in the needle-bed direction in the flat knitting machine and assumes the final form illustrated in FIG. 2 only after the fabric has come out of the machine. In order to relieve the transferred stitches in the stretched connecting region 18, relieving courses are knitted at regular intervals by means of the yarn guide A. These relieving courses extend respectively over the width of the front part 10 or of the shoulder region 14 and over the entire width of one of the two sleeves 11, 12, before a new transfer of stitches then takes place for the purpose of continuing the attachment of the sleeve parts 11, 12. As soon as the attachment of the two sleeve parts 11, 12 to the body parts of the flat fabric is concluded at the points 19, the back part 13 is knitted on, with any desired patterning, according to the arrowed line A.3 by the use of the yarn guide A. A dot-and-dashed line 20 marks the transition of the patterned region of the back part 13 into its rib-edge region 13*b*. This transition point and the region 13*b* terminating in a run-proof end edge 21 are explained below by means of the yarn-run representation of FIG. 3.

A run-proof linking selvedge is likewise formed at the neck opening 15. A knitting process for producing such a linking selvedge is described in German Patent Application P 39 39 584.7.

Figure 3:
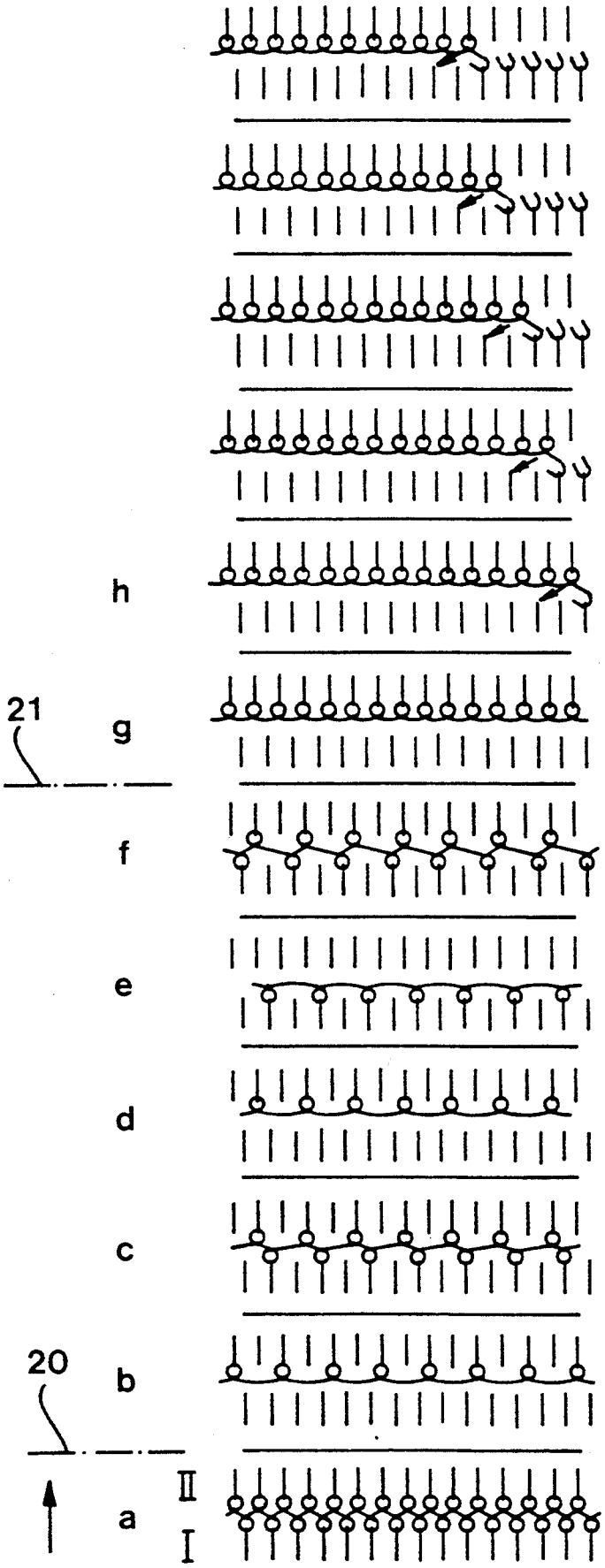
FIG. 3 shows a representation of the yarn run to indicate the formation of a firm end edge of the flat-fabric body part made last.

FIG. 3 shows successive courses in a known type of yarn-run representation. Each course is represented by a pair of line rows, of which the lower line row symbolises the needles of the front needle bed I and the upper line row the needles of the rear needle bed II. The individual courses shown are designated from bottom to top by the letters a, b, c, etc. The lowest course a is a last 1:1 rib course of the patterned region of the back part 13 before the transition point 20 is reached. In the subsequent course b, a 1:1 edge course is knitted and all the stitches of the front needle bed are transferred onto needles of the rear needle bed. Subsequently, a course c is knitted as a so-called net course with needles of the two needle beds I and II. This is followed by a single-bed course d knitted only with needles of the rear needle bed II and thereafter by a single-bed course e knitted only with needles of the front needle bed I. These transitional courses b-e are then followed by a number of rib courses f dependent on the width of the desired rib-edge region 13*b*, these rib courses being knitted by the needles of both needle beds in a needle selection known for a so-called rib border.

At the end 21 of the rib-edge region 13*b*, in a course g all the stitches of the front needle bed are transferred onto the rear needle bed. From the following carriage pass a run-proof binding-off of the fabric is obtained by successive transfer of the individual stitches from one lateral fabric edge into the freed front needle bed. After a racking of this free needle bed, an individual retransfer of the stitches into the rear needle bed occurs, as indicated in FIG. 3 from the course h. Thus, in FIG. 3, the formation of the linking edge takes place from right to left. After the transfer of a stitch from the rear needle bed into the front needle bed, there is a racking of the front needle bed to the left and thereafter a retransfer of the stitch into the rear needle bed. Here too, a process such as that proposed in the applicant's earlier Patent Application P 39 39 584.7 can be adopted.

I claim:

1. A process for producing a fully fashioned flat fabric for a garment with sleeves using a two-bed flat knitting machine having a needle-bed racking device, a stitch-transfer device, a pattern device and three separate yarn guides, comprising the steps of:

knitting a first flat body part, which is one of a front body part and a back body part, from a beginning finished edge with yarn from a first one of the three separate yarn guides and simultaneously but separately knitting two flat sleeves from respective beginning finished edges thereof with yarns from respective other ones of the three yarn guides, said knitting steps being performed according to a pattern of the pattern device and up to end courses of the sleeves;

knitting a remainder of the first body part and a shoulder region provided between the front part and the back part with the first yarn guide;

knitting a second flat body part which is the other of the front body part and back body part from the shoulder region using the first yarn guide to a firm end edge;

during the knitting of the remainder of the first body part and the shoulder region, transferring the end courses of the two sleeves inward stitch by stitch using the stitch transfer device in a direction toward the shoulder region and body parts such that at a start of the second body part the end courses are completely against the body parts; and forming of a neck opening in the shoulder region during the knitting of the shoulder region which includes a run-proof edge.

2. A process for producing a flat fabric as claimed in claim 1 wherein during the knitting of the shoulder region and transferring of the end courses of the sleeves the process further includes the step of continuously knitting relieving courses at regular intervals over the shoulder region and the associated end courses in order to relieve the transferring stitches thereof before a new transferring of stitches takes place and continues the attachment of the sleeves to the body parts.

3. A process for producing a flat fabric s claimed in claim 1 wherein the knitting machine includes two needle beds, and further including the steps of transferring all of the stitches of the back part onto one of the two needle beds, subsequently knitting a net course and a single-bed course in each needle bed, and then knitting a rib-edge to a desired length on both needle beds to produce a rib-edge region at an end of the back part.

4. A process for producing a flat fabric as claimed in claim 1 wherein the knitting machine includes two needle beds, and further including in order to form a firm fabric end edge on the back part the steps of transferring all of the stitches of the back part onto one of the two needle beds, subsequently successively transferring individual stitches from one fabric edge into a free one of the needle beds, and then racking of the free needle bed such that an individual transfer of the stitches takes place whereby a firm fabric end edge is formed on the back part.

5. A process for producing a flat fabric as claimed in claim 1 wherein the knitting machine includes two needle beds, and further including in order to form a run-proof edge at the neck opening the repeated steps from one end of the neck opening to the other of: racking the needle beds, transferring of the stitches thereof, and binding-off of the stitches.

6. A process for producing a flat fabric as claimed in claim 1 wherein the knitting machine includes two needle beds, and further including the steps of transferring al of the stitches of the back part onto one of the two needle beds, subsequently knitting a net course and a single-bed course in each needle bed, and then knitting a rib-edge to a desired length on both needle beds to produce a rib-edge region at an end of the back part.

7. A process for producing a flat fabric as claimed in claim 6 and further including in order to form a firm fabric end edge on the back part the steps of transferring all of the stitches of the back part onto one of the two needle beds, subsequently successively transferring individual stitches from one fabric edge into a free one of the needle beds, and then racking of the free needle bed such that an individual transfer of the stitches takes place whereby a firm fabric end edge is formed on the back part.

8. A process for producing a flat fabric as claimed in claim 7 and further including in order to form a run-proof edge at the neck opening the repeated steps from one end of the neck opening to the other of: racking the needle beds, transferring of the stitches thereof, and binding-off of the stitches.

* * * * *